US007005595B1

(12) United States Patent
Tang

(10) Patent No.: US 7,005,595 B1
(45) Date of Patent: Feb. 28, 2006

(54) LIGHT EMITTING KEYPAD ASSEMBLY

(75) Inventor: Terry Tang, Tucheng (TW)

(73) Assignee: Unitel Rubber Corporation, Tucheng (TW)

( * ) Notice: Subject to any disclaimer, the term of this patent is extended or adjusted under 35 U.S.C. 154(b) by 0 days.

(21) Appl. No.: 11/114,643

(22) Filed: Apr. 25, 2005

(51) Int. Cl.
*H01H 9/00* (2006.01)

(52) U.S. Cl. ..... 200/310; 200/512; 200/314

(58) Field of Classification Search ..... 200/310–314, 200/511–512, 5 A; 341/22–27
See application file for complete search history.

(56) References Cited

U.S. PATENT DOCUMENTS

| | | | | |
|---|---|---|---|---|
| 4,349,705 | A * | 9/1982 | Kuhfus | 379/361 |
| 4,449,024 | A * | 5/1984 | Stracener | 200/317 |
| 5,664,667 | A * | 9/1997 | Kenmochi | 200/314 |
| 6,100,478 | A * | 8/2000 | LaPointe et al. | 200/314 |
| 6,605,789 | B1 * | 8/2003 | Chen et al. | 200/310 |
| 6,743,993 | B1 * | 6/2004 | Clark et al. | 200/314 |
| 6,777,626 | B1 * | 8/2004 | Takabatake et al. | 200/5 A |

* cited by examiner

*Primary Examiner*—Kyung Lee
(74) *Attorney, Agent, or Firm*—Dellett & Walters

(57) ABSTRACT

A light-emitting keypad assembly is mounted on a substrate of a cellular phone and has a silicon layer, an illuminating layer formed on top of the silicon layer, multiple keys formed on top of the illuminating layer and multiple protrusions formed on the bottom of the silicon layer. When the keys are pressed down, the protrusions directly press against contacts on the substrate without any obstruction. The light from the light-emitting layer is able to penetrate all the keys to make the light emitting keypad assembly bright.

6 Claims, 2 Drawing Sheets

LIGHT EMITTING KEYPAD ASSEMBLY

BACKGROUND OF THE INVENTION

1. Field of the Invention

The present invention relates to a keypad assembly for a cellular phone, and more particularly to a light emitting keypad assembly that is able to emit a great deal of light.

2. Description of Related Art

Cellular phones often are people's most popular electronic appliances and make people available virtually everywhere. A conventional cellular phone only has a basic communication function. However, people want to have more functions on their cellular phones. A keypad assembly on a cellular phone can emit light selectively when requested by a user.

With reference to FIG. 3, a conventional keypad assembly for a cellular phone is mounted on a substrate (30) of a cellular phone and comprises a silicon layer (33), multiple protrusions (34), multiple light-emitting diodes (LEDs)(32), multiple keys (35) and a protective layer (36). The silicon layer (33) has top and bottom. The protrusions (34) are formed on the bottom of the silicon layer (33) and correspond to and engage an electrical tab (31) of the substrate (30). The LEDs (32) are mounted on the bottom of the silicon layer (33) between the protrusions (34) and the contacts (31). The keys (35) are formed on the top of the silicon layer (33) and cause the LEDs (32) to emit light when the keys (35) are pressed. Light from the LEDs (32) passes through the silicon layer (33) and indirectly lights the keys (35) since the light cannot directly pass through the keys (35). The protective layer (36) is formed on the top of the silicon layer (33) between the keys (35).

As cellular phones continue to get smaller and smaller, large and bright LEDs (32) are not able to fit into the cellular phone.

The manufacturers of keypads for cellular phones have begun to use a luminescent layer as a light source to replace the LEDs (32) and accommodate the smaller size of the new cellular phones. With reference to FIG. 4, a luminescent layer (40) is mounted between the silicon layer (33) and the substrate (30). When the keys (35) are pressed down, the protrusions (34) press the luminescent layer (40) and the contacts (31). The luminescent layer (40) emits light, and the light of the luminescent layer (40) passes through the silicon layer (33) and is emitted from the top of the silicon layer (33). Because the luminescent layer (40) is between the silicon layer (33) and the substrate (30), the protrusions (34) have difficulty pressing the contacts (31) when the protrusions (34) are pressed. Furthermore, a conventional light-emitting layer a luminescent layer (40) is at the bottom of the luminescent layer (40) so the brightness of light emitted from the luminescent layer (40) is greatly reduced.

To overcome the shortcomings, the present invention provides a light emitting keypad assembly to obviate or mitigate the aforementioned problems.

SUMMARY OF THE INVENTION

The primary objective of the present invention is to provide a light emitting keypad assembly that is able to emit bright light.

The light emitting keypad assembly is mounted on a substrate of a cellular phone and has a silicon layer, an illuminating layer, multiple keys and multiple protrusions. The illuminating layer is formed on top of the silicon layer. The keys are formed on top of the illuminating layer. The protrusions are formed on the bottom of the silicon layer. When the keys are pressed down, the protrusions directly press against contacts on the substrate without any obstruction. Light from the light emitting layer penetrates all the keys to make the light emitting keypad assembly bright.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
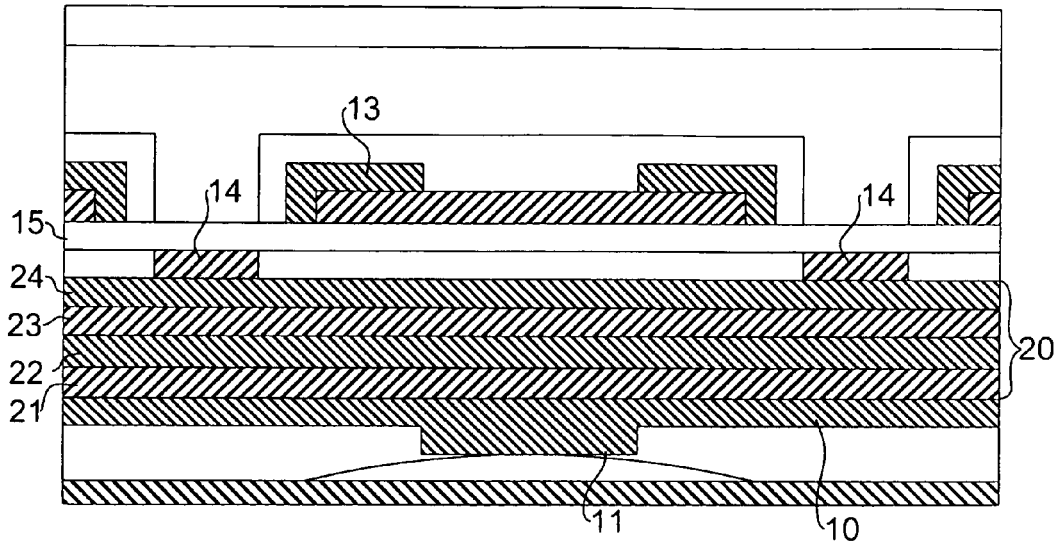
FIG. 1 is a side view in partial section of a first embodiment of a light emitting keypad assembly in accordance with the present invention.
Figure 2:
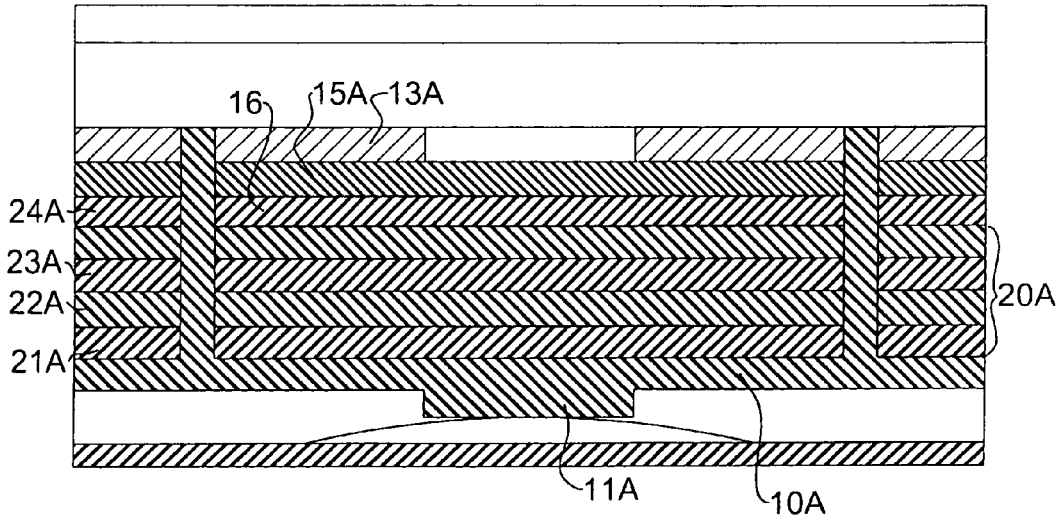
FIG. 2 is a side view in partial section of a second embodiment of a light emitting keypad assembly in accordance with the present invention.
Figure 3:
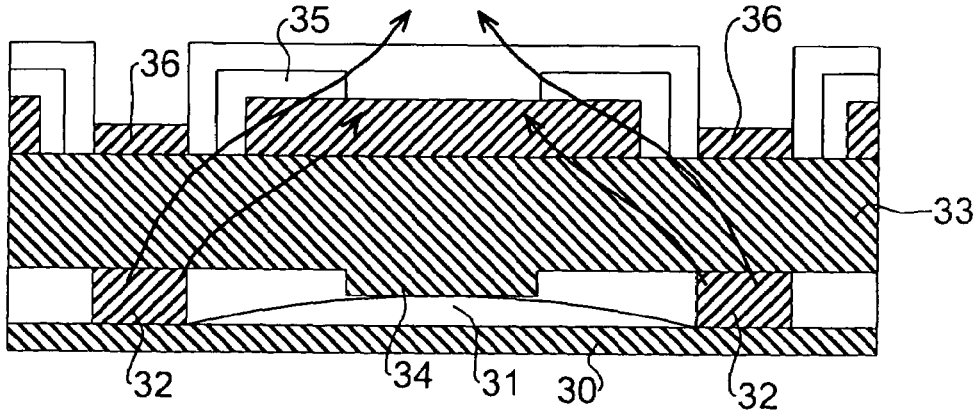
FIG.3 PRIOR ART
FIG. 3 is a side view in partial section of a first embodiment of a conventional keypad assembly for a cellular phone in accordance with the prior art.
Figure 4:
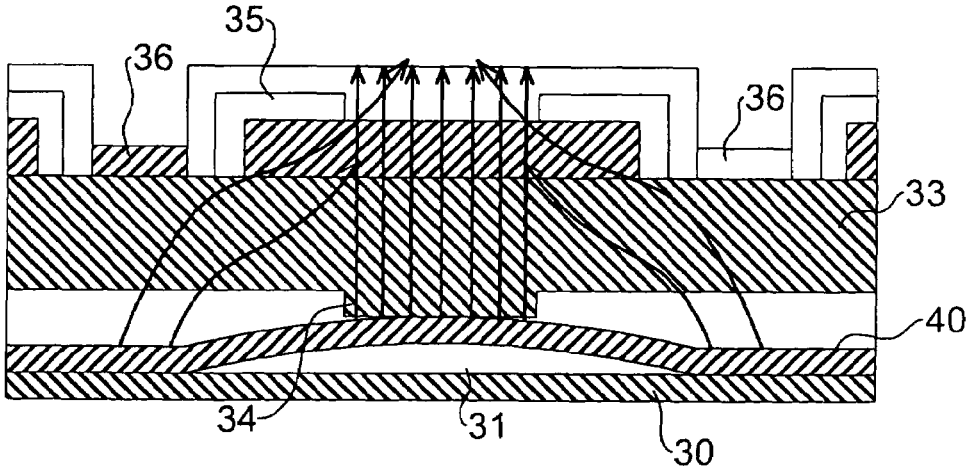
FIG.4 PRIOR ART
FIG. 4 is a side view in partial section of a second embodiment of a conventional keypad assembly for a cellular phone in accordance with the prior art.

With reference to FIGS. 1 and 2, a light emitting keypad assembly in accordance with the present invention is mounted on a substrate (not numbered) of a cellular phone. The substrate of the cellular phone has a top surface and multiple contacts (not numbered) on the top surface of the substrate.

The light emitting keypad assembly comprises a silicon layer (10, 10A), an illuminating layer (20, 20A), a mask layer (14, 16), an optional electric conductor layer (15, 15A) and multiples keys (13, 13A). The silicon layer (10, 10A), the illuminating layer (20, 20A), the mask layer (14, 16) and the electric conductor layer (15, 15A) are formed sequentially on top of each other.

The silicon layer (10, 10A) has a top, a bottom and multiple protrusions (11, 11A). The protrusions (11, 11A) are formed on the bottom of the silicon layer (10, 10A) and press respectively against the contacts on the substrate.

The illuminating layer (20, 20A) has a top, a waterproof protective layer (21, 21A), an electrode layer (22, 22A), an insulation layer (23, 23A) and a light-emitting layer (24, 24A), which are mounted sequentially on top of each other. The light-emitting layer (24, 24A) is a phosphor-powder compound and emits light when excited electrically.

In a first embodiment of the light-emitting keypad assembly in accordance with the present invention, the mask layer (14) is transparent and has intermittent masks to block part of the light emitted from the light-emitting layer (24).

In a second embodiment of the light-emitting keypad assembly in accordance with the present invention, the mask layer (16) is colored so the light emitted from the light-emitting layer (24A) will be colored after passing through the mask layer (16).

The electric conductor layer (15, 15A) is light permeable indium tin oxide, is able to conduct electricity and has a top. The keys (13, 13A) are formed on the top of the electric conductor layer (15, 15A) so light from the light-emitting layer (24, 24A) is able to penetrate the mask layer (14, 16) to illuminate the keys (13, 13A).

In conclusion, the protrusions (11, 11A) of the silicon layer (10, 10A) directly engage the contacts on the substrate without any obstructing when the keys (13, 13A) of the light emitting keypad assembly are pressed down. Furthermore, the light emitting layer (24, 24A) is at the top of the illuminating layer (20, 20A) so light from the light emitting layer (24, 24A) is able to penetrate all the keys (13, 13A) to make the light emitting keypad assembly bright.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A light-emitting keypad assembly adapted to be mounted on a substrate of a cellular phone, the substrate having a top surface and multiple contacts on the top surface, and the light emitting keypad assembly comprising:

a silicon layer having a top;

a bottom; and multiple protrusions formed on the bottom of the silicon layer and adapted for pressing respectively against the contacts on the substrate;

an illuminating layer mounted on the top of the silicon layer and having a top;

a waterproof protective layer formed on the top of the silicon layer;

an electrode layer formed on a top of the waterproof protective layer;

an insulation layer formed on a top of the electrode layer; and a light-emitting layer formed on a top of the insulation layer and made of a phosphor-powder compound;

a mask layer being transparent and formed on the top of illuminating layer; and multiple keys formed on the top of mask layer.

2. The light-emitting keypad assembly as claimed in claim 1 further comprising an electric conductor layer mounted between the mask layer and the keys.

3. The light-emitting keypad assembly as claimed in claim 1, wherein the mask layer has intermittent masks to block part of the light emitted from the light-emitting layer.

4. The light-emitting keypad assembly as claimed in claim 2, wherein the mask layer has intermittent masks to block part of the light from the light-emitting layer.

5. The light-emitting keypad assembly as claimed in claim 1, wherein the mask layer is colored so light emitted from the light-emitting layer is colored after passing through the mask layer.

6. The light-emitting keypad assembly as claimed in claim 2, wherein the mask layer is colored so light emitted from the light-emitting layer is colored after passing through the mask layer.

* * * * *